US005221180A

United States Patent [19]

Crider

[11] Patent Number: 5,221,180

[45] Date of Patent: Jun. 22, 1993

[54] FAN HOUSING WITH SCREEN SECURING MEANS

[75] Inventor: Grantlin W. Crider, Bremen, Ala.

[73] Assignee: Hired Hand Manufacturing, Inc., Bremen, Ala.

[21] Appl. No.: 916,631

[22] Filed: Jul. 22, 1992

[51] Int. Cl.[5] ..... F01D 25/24

[52] U.S. Cl. ..... 415/121.200; 415/182.1; 415/208.1; 415/214.1; 415/211.2; 416/247 R; 403/11; 403/274

[58] Field of Search ..... 415/121.2, 182.1, 183, 415/208.1, 211.2, 214.1, 220; 416/244 R, 247 R; 417/423.9, 423.14; 403/11, 233, 242, 274

[56] References Cited

U.S. PATENT DOCUMENTS

| | | | |
|---|---|---|---|
| 2,628,020 | 2/1953 | Koch | 415/208.1 |
| 3,402,882 | 9/1968 | Militello | 415/121.2 |
| 4,021,988 | 5/1977 | Edeus et al. | 403/274 |
| 4,781,526 | 11/1988 | Mead | 415/121.2 |

FOREIGN PATENT DOCUMENTS

| | | | |
|---|---|---|---|
| 0556346 | 4/1958 | Canada | 416/247 R |

*Primary Examiner*—Edward K. Look
*Assistant Examiner*—Christopher Verdier
*Attorney, Agent, or Firm*—Veal & Associates

[57] ABSTRACT

A unitized metallic fan housing having a peripheral wall spaced about a fan's axis of rotation and extending axially therebeyond. A plurality of flanges are integrally connected to and extend substantially perpendicular to the peripheral wall toward the axis of rotation. At least one screen is connected to the flanges by rigid but malleable tabs formed thereon that are bent around a peripheral strand of the screen. Apertures are defined by and extend through the flanges to provide access to the tabs such that the tabs may be urged toward the peripheral wall to tension the screen therewithin, whereby the rigid nature of the tabs secures the screen to the flanges in a tensioned position. Holes are defined by and extend through the peripheral wall to provide access to the tabs such that the tabs may be urged from the peripheral wall to reduce the tension of the screen and to disengage the peripheral strand from the tabs such that the screen may be removed from the peripheral wall and replaced.

11 Claims, 2 Drawing Sheets

Fig. 1
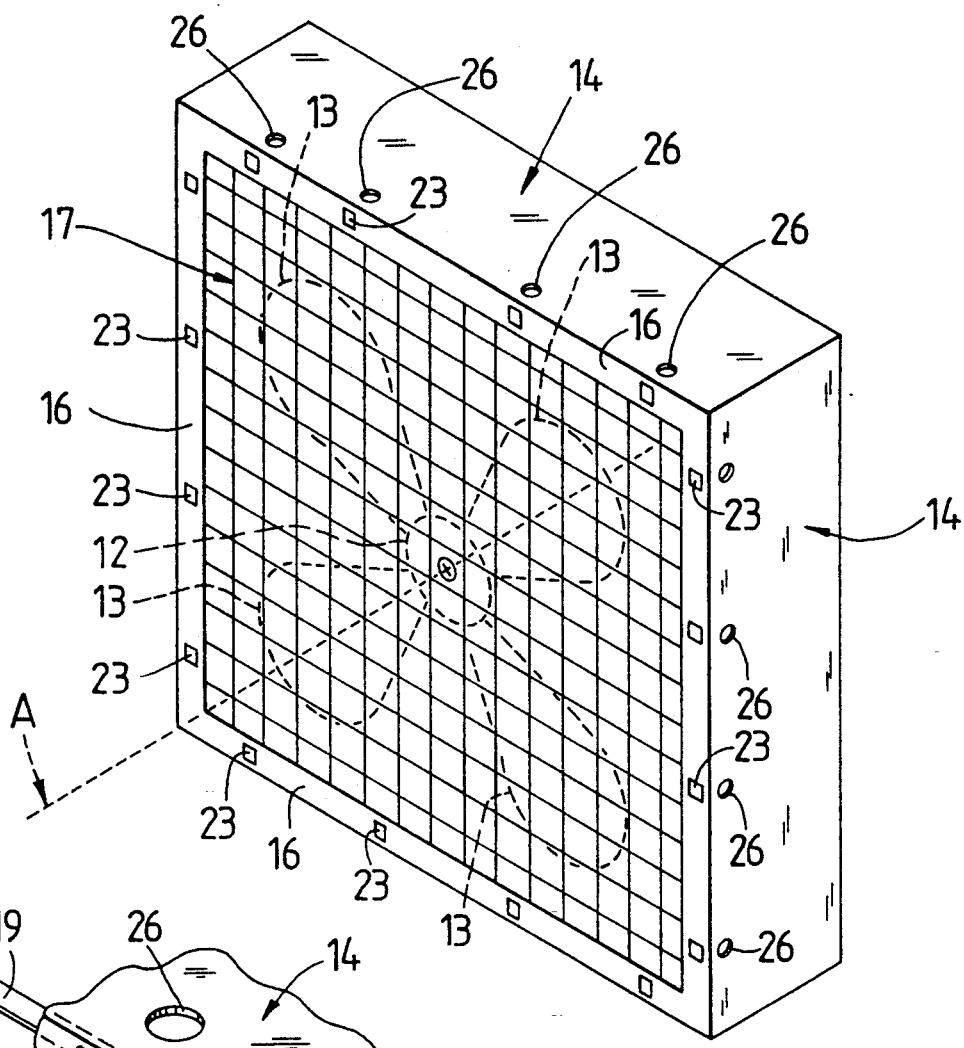
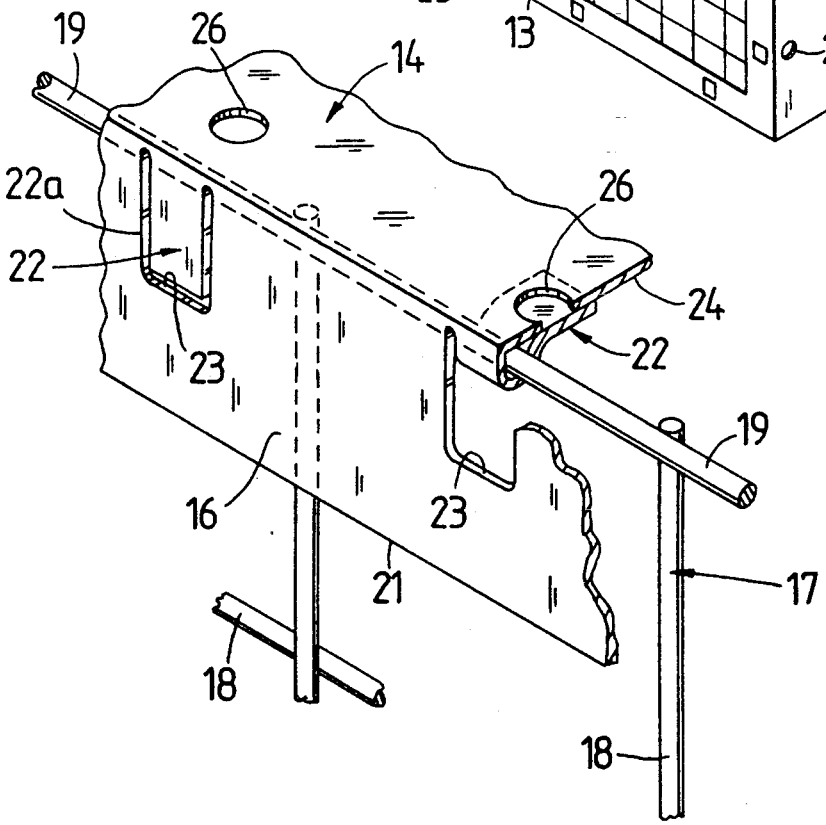
Fig. 2

FAN HOUSING WITH SCREEN SECURING MEANS

FIELD OF THE INVENTION

The present invention relates to industrial rotary fans used primarily to ventilate poultry, livestock and greenhouses. In greater particularity, the present invention relates to the housings in which the blades of such rotary fans are contained. In even greater particularity, the present invention relates to those fan housings that are made of metal and have a peripheral wall radially disposed about the blades and further having screens, constructed of perpendicular strands of interconnected wire, that are connected to the peripheral wall to prevent inadvertent insertion of foreign objects therewithin.

BACKGROUND OF THE INVENTION

Large rotary fans are commonly used to circulate air within these houses and can be mounted within a wall thereof to circulate fresh air into or out of the house or hung out in the house to just circulate the air. Such fans include a wooden or metallic peripheral wall disposed about the fan's blades and motor in substantially coaxial relation to the axis about which the blades are rotated. The peripheral wall extends axially beyond the blades and motor, which are mounted internally of the wall by a frame connected thereto. One or more flanges extend from forward and rearward margins of the peripheral wall in substantial perpendicular relation thereto toward the aforesaid axis. Screens are connected to the flanges to prevent inadvertent insertion of foreign objects into the path of the fan blades.

The screens are constructed of perpendicular interconnected wire strands and further include one or more peripheral strands defining the lateral margin of the screen. The screens are typically mounted to the fan housing using plastic or wire ties which suspend the screens from the flanges. Alternatively, screws, having members attached thereto for engaging the peripheral strands, are threadably secured to the flanges to support the screen adjacent thereto. The problem with these methods of mounting the screens is that no tension is applied to the screen. As a result, the screens will eventually warp, becoming generally unattractive and, more importantly, may deflect and possibly become entangled with the fan blades if struck by an object. Most fans have brace members connected to the peripheral wall and extending adjacent the screen to prevent a warped screen from becoming entangled. Further, the screws and ties commonly used to secure the screens frequently disengage from the screen or flanges. The loss of the ties or screws diminishes the screen's effectiveness and could eventually result in the screen falling from the fan or becoming entangled therein.

Screens have been developed wherein the wire is tensioned and integrally connected to a peripheral frame prior to connecting the frame to the flanges. The process of connecting the wire to the frame is relatively complex as the frame is folded over the peripheral strands and stamped in close securing engagement therewith while the wire is held in tension by other apparatus. The machinery and labor necessary to perform this procedure are relatively expensive. Though the screen is tensioned, the cost of manufacture precludes the practical use of such screens for use on fans for livestock houses. Further, the frame is attached to the flanges using screws or ties and is susceptible to the shortcomings set forth above. Note that the tension in the framed screen is preset and cannot be adjusted. If the screen should lose tension, no apparatus and method are available to retension the strands.

SUMMARY OF THE INVENTION

It is the principal object of the present invention to provide a unitized metal fan housing for containing fans used in livestock houses.

In support of the principal object, another object of the present invention is to provide a unitized metal fan housing wherein a screen is releasably engaged by portions of the housing, thus eliminating the need for detachable connectors.

Yet another object of the present invention is to provide a unitized housing wherein the screen may be tensioned as it is secured to the housing.

Still another object of the present invention is to provide a unitized housing wherein the tension of the screens may be adjusted.

These and other objects and advantages of the present invention are accomplished through the use of one or more flanges integrally connected to the peripheral wall and having a plurality of rigid but malleable tabs integrally connected to the flanges and forming a portion thereof that extend around the screen's peripheral strands then toward the peripheral wall. The tabs may be accessed by apertures defined by and extending through the flanges adjacent to the tabs such that the tabs may be urged toward the peripheral wall to tension the screen. Holes are defined by and extend through the peripheral wall, proximal to the tabs to provide access thereto such that the tabs may be urged from the wall to reduce the tension of the screen or disengage the screen from the tabs.

BRIEF DESCRIPTION OF THE DRAWINGS

Apparatus embodying features of my invention are depicted in the accompanying drawings which form a portion of this disclosure and wherein:

FIG. 1 is a perspective view of the present invention;

FIG. 2 is a detailed perspective of the present invention;

DESCRIPTION OF A PREFERRED EMBODIMENT

Figure 3:
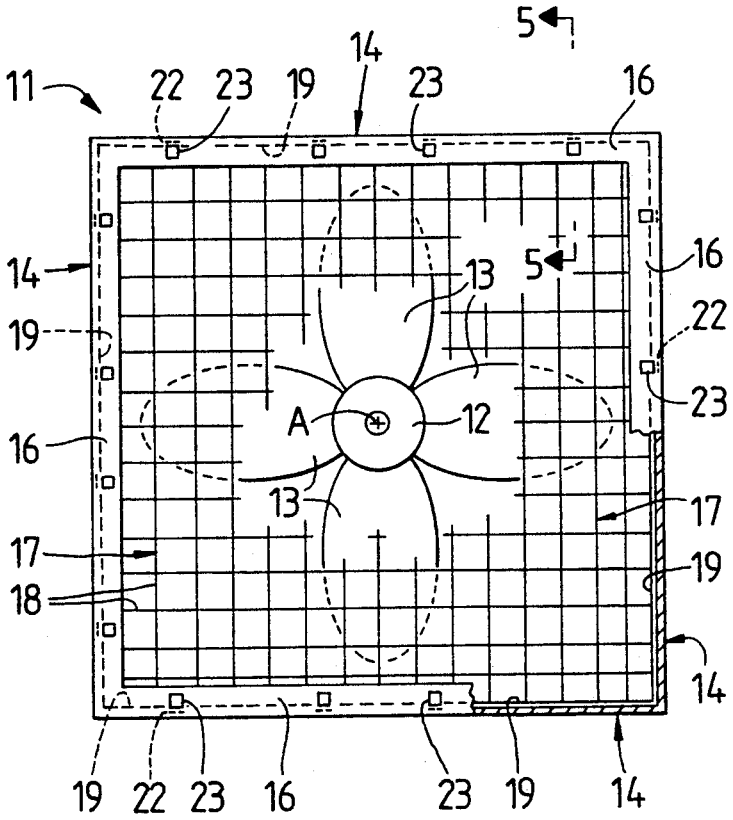
FIG. 3 is a side elevational view of the present invention.

Referring to the drawings for a clearer understanding of the invention, it should be noted in FIG. 1 that the present invention contemplates the use of a fan 11 having a hub 12 with blades 13 that rotate about an axis of rotation A. The hub 12 and driving motor (not shown) are mounted within a metallic peripheral wall 14 that is spaced about the axis A and extends axially beyond the fan 11. A plurality of metallic flanges 16 are integrally connected to and extend substantially perpendicularly of the peripheral wall 14 toward the axis A. The material from which the peripheral wall 14 and flanges 16 are constructed may be aluminum or other such rigid but malleable metals. A metallic wire screen 17 is mounted to the flanges 16 on either side of the fan 11.

Figure 5:
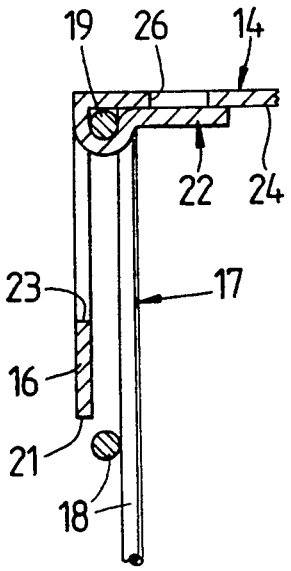
FIG. 5 is a detailed sectional view taken along line 5—5 of FIG. 3.
Figure 4:
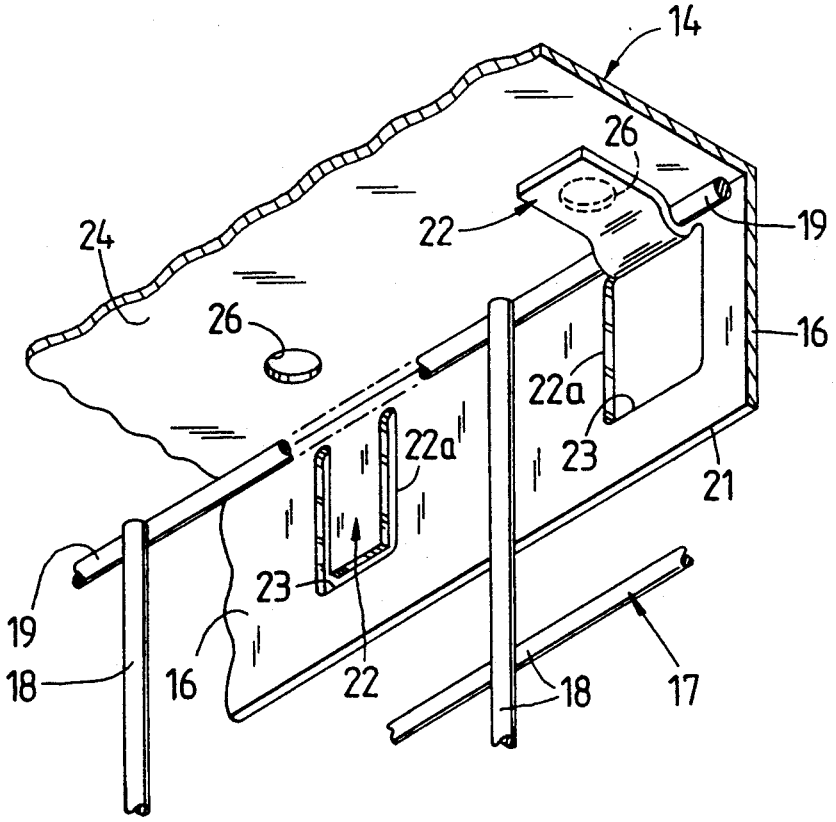
FIG. 4 is a detailed perspective view taken from within the present invention and showing a tab engaging a peripheral strand.

As shown in FIGS. 1–3, the screen 17 includes a plurality of perpendicular interconnected strands 18 and a peripheral strand 19 which forms a perimeter measuring less than the peripheral wall 14 and more than an inner perimeter 21 defined by the innermost edges of the plurality of flanges 16. The plurality of flanges 16 have a plurality of rigid but malleable tabs 22 formed thereon. The tabs 22 are formed by cutting a profile 22*a* of the tabs 22 within the flange 16 as shown in FIG. 4. The unitized construction of the housing and screen 17 is accomplished by placing the screen 17 within the wall 14 between the flanges 16 and the blades. The strand 19 is engaged by folding the tabs 22 about the strand 19 toward the peripheral wall 14. The tabs 22 extend from the flanges 16 a short distance toward the axis A and around the peripheral strand 19. Folding the tabs 22 opens a plurality of apertures 23 that are formed thereby intermediate the perimeter 21 and peripheral strand 19 when the tabs 22 are cut and folded from the flanges 16. As shown in FIGS. 2, 4 and 5, the tabs 22 may be accessed through the apertures 23 and urged toward the peripheral wall 14 and against an interior face 24 of peripheral wall 14 to tension the screen 17 and secure the screen 17 at a selected tensioned position.

Holes 26 are defined by and extend through the peripheral wall 14 proximal to the tabs 22. The holes 26 provide access to the tabs 22 such that the tabs 22 may be urged downwardly from the peripheral wall 14 and from the interior face 24 to reduce the tension of screen 17. Continued movement of the tabs 22 from the peripheral wall 14 will disengage the peripheral strands 19 from the tabs 22 to facilitate removal and replacement of the screen 17. From the foregoing, it should be clear that the present invention represents a substantial improvement over the prior art.

while I have shown my invention in one form, it will be obvious to those skilled in the art that it is not so limited but is susceptible of various changes and modifications without departing from the spirit thereof.

What I claim is:

1. A unitized fan housing for use in a livestock housing, comprising:

(a) at least one peripheral wall spaced about the axis of rotation of said fan and extending axially therebeyond;

(b) one or more flanges integrally connected to and extending substantially perpendicularly of said peripheral wall toward said axis of rotation;

(c) at least one screen having a plurality of perpendicular interconnected strands including one or more peripheral strands forming a perimeter measuring less than said peripheral wall and more than an inner perimeter defined by said one or more flanges; and (d) retaining means comprising a plurality of rigid but malleable tabs integrally connected to said one or more flanges intermediate said peripheral wall and said peripheral strands then toward said peripheral wall, wherein said plurality of tabs are urged toward said peripheral wall to a tensioned position to tension said screen and hold said screen in tension within said peripheral wall.

2. A unitized metallic fan housing as defined in claim 1 further comprising a plurality of apertures defined by said one or more flanges adjacent said plurality of tabs and intermediate said plurality of tabs and said inner perimeter of said one or more flanges such that said plurality of tabs may be accessed through said plurality of apertures and urged toward said peripheral wall to tension said screen therewithin.

3. A unitized metallic fan housing as defined in claim 2 further comprising a plurality of holes defined by said peripheral wall proximal to said plurality of tabs, wherein said tabs may be accessed through said holes and urged from said peripheral wall to disengage said one or more ,peripheral strands.

4. A unitized metallic fan housing as defined in claim 2 further comprising a plurality of holes defined by said peripheral wall proximal to said plurality of tabs, wherein said tabs may be accessed through said holes and urged from said peripheral wall to disengage said one or more peripheral strands.

5. A unitized metallic fan housing as defined in claim 1 further comprising a plurality of apertures defined by said one or more flanges adjacent said retaining means for accessing said retaining means to urge said one or more peripheral strands toward said peripheral wall and thereby tension said screen therewithin.

6. A unitized metallic fan housing as defined in further comprising a plurality of holes defined by and extending through said peripheral wall proximal to said retaining means for accessing said retaining means to disengage said one or more peripheral strands.

7. A unitized metallic fan housing for use in a livestock house, said housing comprising:

(a) at least one peripheral wall spaced about the axis of rotation of said fan and extending axially therebeyond;

(b) one or more flanges integrally connected to and extending substantially perpendicularly of said peripheral wall toward said axis of rotation;

(c) at least one screen having a plurality of perpendicular interconnected strands including one or more peripheral strands forming a perimeter measuring less than said peripheral wall and more than an inner perimeter defined by said one or more flanges, wherein said one or more peripheral strands extend along an inner side of said one or more flanges and within said peripheral wall; and (d) a plurality of rigid and malleable tabs connected to said one or more flanges intermediate said peripheral wall and said peripheral strands and extending around said peripheral strands then toward said peripheral wall, wherein said plurality of tabs are urged toward said peripheral wall to a tensioned position to tension said screen and hold said screen in tension within said peripheral wall.

8. A unitized metallic fan housing as defined in claim 7 further comprising a plurality of apertures defined by said one or more flanges adjacent said plurality of tabs and intermediate said plurality of tabs and said inner perimeter of said one or more flanges such that said plurality of tabs may be accessed through said plurality of apertures and urged toward said peripheral wall to tension said screen therewithin.

9. A unitized metallic fan housing as defined in claim 7 further comprising a plurality of holes defined by said peripheral wall proximal to said plurality of tabs, wherein said tabs may be accessed through said holes and urged from said peripheral wall to disengage said one or more peripheral strands.

10. A unitized metallic fan housing for use in a livestock house, said housing comprising:

(a) at least one peripheral wall spaced about the axis of rotation of said fan and extending axially therebeyond;

(b) one or more flanges integrally connected to and extending substantially perpendicularly of said peripheral wall toward said axis of rotation;

(c) at least one screen having a plurality of perpendicular interconnected strands including one or more peripheral strands forming a perimeter measuring less than said peripheral wall and more than an inner perimeter defined by said one or more flanges, wherein said one or more peripheral strands extend along an inner side of said one or more flanges and within said peripheral wall; and (d) a plurality of tabs formed by said one or more flanges wherein said tabs are rigid but bendable and extend from said one or more flanges, around said one more peripheral strands, then toward said peripheral wall to secure said screen to said one or more flanges, wherein said tabs are urged toward said peripheral wall to maintain tension on said screen therewithin; and (e) a plurality of apertures defined by said one or more flanges adjacent said plurality of tabs and intermediate said plurality of tabs and said inner perimeter of said one or more flanges such that said plurality of tabs may be accessed through said plurality of apertures and urged toward said peripheral wall to tension said screen therewithin.

11. A unitized metallic fan housing as defined in claim 10 further comprising a plurality of holes defined by said peripheral wall proximal to said plurality of tabs, wherein said tabs may be accessed through said holes and urged from said peripheral wall to disengage said one or more peripheral strands.

* * * * *